US011946338B2

(12) United States Patent
Green et al.

(10) Patent No.: US 11,946,338 B2
(45) Date of Patent: Apr. 2, 2024

(54) SLEEVE CONTROL VALVE FOR HIGH TEMPERATURE DRILLING APPLICATIONS

(71) Applicant: Baker Hughes, Houston, TX (US)

(72) Inventors: Ryan Damont Green, League City, TX (US); Sebastian Tegeler, Hannover (DE); Andreas Peter, Celle (DE); Thomas Kruspe, Wietzendorf (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 939 days.

(21) Appl. No.: 16/889,063

(22) Filed: Jun. 1, 2020

(65) Prior Publication Data

US 2020/0291743 A1 Sep. 17, 2020

Related U.S. Application Data

(63) Continuation-in-part of application No. 15/066,389, filed on Mar. 10, 2016, now Pat. No. 10,669,812.

(51) Int. Cl.

| | |
|---|---|
| ***E21B 34/06*** | (2006.01) |
| ***E21B 34/14*** | (2006.01) |
| ***E21B 47/18*** | (2012.01) |

(52) U.S. Cl.

CPC ..... *E21B 34/066* (2013.01); *E21B 34/14* (2013.01); *E21B 47/18* (2013.01); *E21B 2200/06* (2020.05)

(58) Field of Classification Search

CPC .... E21B 34/066; E21B 34/14; E21B 2200/06; E21B 47/18

See application file for complete search history.

(56) References Cited

U.S. PATENT DOCUMENTS

| | | | |
|---|---|---|---|
| 2,278,532 | A | 4/1942 | Crickmer |
| 3,065,416 | A | 11/1962 | Jeter |

(Continued)

FOREIGN PATENT DOCUMENTS

| | | | |
|---|---|---|---|
| EP | 0088402 | A2 | 9/1983 |
| GB | 2250320 | A | 6/1992 |

(Continued)

OTHER PUBLICATIONS

Notification of Transmittal of the International Search Report and the Written Opinion of the International Searching Authority PCT/US2017/021329; dated May 10, 2017; 12 pages.

(Continued)

*Primary Examiner* — Robert E Fuller
*Assistant Examiner* — Neel Girish Patel
(74) *Attorney, Agent, or Firm* — CANTOR COLBURN LLP

(57) ABSTRACT

A control valve assembly includes a body having a fluid inlet and a fluid outlet. A portion of the body is formed from a first magnetic material. A sleeve is slidingly mounted to the body. At least a portion of the sleeve is formed from a second magnetic material. A magnetic circuit having a gap is defined within the control valve assembly. A solenoid is mounted to the body about at least a portion of the first magnetic material of the body. The solenoid is selectively activated to create a magnetic field across the gap in the magnetic circuit. The magnetic circuit causes the sleeve to slide, narrowing the gap and sliding from the first position to the second position to produce a pressure pulse in the wellbore, wherein the biasing member biases the sleeve back to the first position.

20 Claims, 4 Drawing Sheets

(56) References Cited

U.S. PATENT DOCUMENTS 3,523,676 A 8/1970 Barker
3,958,217 A 5/1976 Spinnler
3,964,556 A 6/1976 Gearhart
4,078,620 A 3/1978 Westlake et al.
4,336,564 A 6/1982 Wisniewski et al.
4,351,037 A 9/1982 Scherbatskoy
4,386,422 A 5/1983 Mumby
4,515,225 A 5/1985 Dailey
4,550,392 A 10/1985 Mumby
4,628,495 A 12/1986 Peppers
4,719,979 A 1/1988 Jones
4,739,829 A * 4/1988 Brunner ..... E21B 27/02 166/63
4,819,745 A 4/1989 Walter
4,825,421 A 4/1989 Jeter
4,873,488 A 10/1989 Barber et al.
4,981,173 A * 1/1991 Perkins ..... E21B 34/066 251/129.09
5,070,595 A 12/1991 Perkins et al.
5,073,877 A 12/1991 Jeter
5,103,430 A 4/1992 Jeter et al.
5,182,731 A 1/1993 Hoelscher
5,275,337 A 1/1994 Kolarik et al.
5,303,776 A 4/1994 Ryan
5,333,686 A 8/1994 Vaughan
5,660,238 A 8/1997 Earl et al.
6,002,643 A 12/1999 Tchakarov
6,016,288 A 1/2000 Frith
6,199,823 B1 3/2001 Dahlgren et al.
6,244,342 B1 * 6/2001 Sullaway ..... E21B 33/14 166/318
6,328,112 B1 12/2001 Malone
6,464,011 B2 10/2002 Tubel
6,555,926 B2 4/2003 Gondron
6,626,244 B2 9/2003 Powers
6,714,138 B1 3/2004 Turner
6,811,135 B2 11/2004 Moreno et al.
6,898,150 B2 5/2005 Hahn
6,918,409 B1 * 7/2005 Parker ..... F02M 63/0042 251/325
7,350,588 B2 4/2008 Abercrombie Simpson et al.
7,921,876 B2 4/2011 Wright et al.
8,365,821 B2 2/2013 Hall et al.
8,469,104 B2 6/2013 Downton
8,534,381 B1 9/2013 Rinald
8,627,883 B2 1/2014 Richards
8,627,893 B2 1/2014 Otto et al.
8,640,768 B2 2/2014 Hall et al.
8,672,025 B2 3/2014 Wolf et al.
8,905,075 B2 12/2014 Tower
8,912,915 B2 12/2014 Hay et al.
2002/0117644 A1 8/2002 Carrillo et al.
2003/0024706 A1 2/2003 Allamon
2003/0047317 A1 3/2003 Powers
2004/0069530 A1 4/2004 Prain
2007/0056771 A1 3/2007 Gopalan et al.
2008/0060801 A1 * 3/2008 Ocalan ..... E21B 43/123 166/321
2008/0236841 A1 10/2008 Howlett et al.
2008/0236842 A1 10/2008 Bhavsar et al.
2009/0009174 A1 1/2009 Forgang et al.
2009/0114396 A1 5/2009 Kusko et al.
2010/0089587 A1 4/2010 Stout
2010/0102264 A1 4/2010 Bickoff et al.
2010/0195442 A1 8/2010 Reyes et al.
2011/0155392 A1 6/2011 Frazier
2011/0232791 A1 9/2011 Bengea et al.
2011/0278017 A1 11/2011 Themig et al.
2012/0118582 A1 5/2012 Soni et al.
2012/0247755 A1 * 10/2012 Colon ..... E21B 27/02 166/168
2012/0261603 A1 10/2012 Kahn et al.
2012/0279723 A1 11/2012 Hofman
2013/0269928 A1 * 10/2013 Zhou ..... E21B 21/08 166/113
2014/0000909 A1 * 1/2014 Neer ..... E21B 34/108 166/334.1
2014/0034325 A1 2/2014 Jancha et al.
2014/0284112 A1 9/2014 Cenac et al.
2014/0332277 A1 11/2014 Churchill
2015/0034386 A1 2/2015 Reed et al.
2015/0107902 A1 4/2015 Downton
2015/0260014 A1 9/2015 Zimmerman
2015/0322753 A1 11/2015 Zimmerman, Jr.
2016/0265350 A1 9/2016 Brown-Kerr et al.
2016/0341001 A1 11/2016 Scholz et al.
2016/0369596 A1 12/2016 McMillon et al.
2017/0260831 A1 9/2017 Green
2017/0260832 A1 9/2017 Green et al.
2017/0260852 A1 9/2017 Green et al.
2019/0218909 A1 7/2019 Green et al.
2019/0226331 A1 7/2019 Green et al.

FOREIGN PATENT DOCUMENTS

JP 2003097756 A 4/2003
WO 2007021274 A1 2/2007
WO 2014094150 A1 6/2014
WO 2015017522 A1 2/2015
WO 2015174951 A1 11/2015

OTHER PUBLICATIONS

Notification of Transmittal of the International Search Report and the Written Opinion of the International Searching Authority, or the Declaration; PCT/US2017/021327; dated May 10, 2017; 15 pages.
Notification of Transmittal of the International Search Report and the Written Opinion of the International Searching Authority, or the Declaration; PCT/US2017/021331; dated May 31, 2017; 13 pages.
Schlumberger, "High Temperature Drilling Operations—An Industry Challenge" www.slb.com/HTdrilling 12 pages.
European Application No. 17763986.1 filed Mar. 8, 2017; Extended European Search Report dated Sep. 20, 2019; 7 pages.

* cited by examiner

SLEEVE CONTROL VALVE FOR HIGH TEMPERATURE DRILLING APPLICATIONS

CROSS REFERENCE TO RELATED APPLICATIONS

The present application is a continuation-in-part of U.S. patent application Ser. No. 15/066,389 filed Mar. 10, 2016, the contents of which are hereby incorporated in their entirety.

BACKGROUND

Downhole operations often include a downhole string that extends from an uphole system into a formation. The uphole system may include a platform, pumps, and other systems that support drilling operation, resource exploration, development, and extraction. In some instances, fluids may be passed from the uphole system into the formation through the downhole string. In other instances, fluid may pass from the formation through the downhole string to the uphole system. The downhole string may include various sensors that detect downhole parameters including formation parameters and parameters associated with the downhole string.

It is desirable to communicate information from downhole sensors to the uphole system. Communication may take place through wired, optical, or acoustical systems. Acoustical systems rely upon passage of pressure pulses generated downhole by a mud pulser to an uphole receiver. The pressure pulses are created by moving a piston into a choke valve in order to create an additional temporarily pressure increase at the pump system on the surface. The generated pressure pulse travels to the surface. The uphole receiver converts the pressure pulses to data indicative of sensed parameters. The pressure pulses provide useful information to uphole operators.

During drilling, a typical mud pulser substantially continuously generates pressure pulses over long time periods, often several days. In addition, a number of wellbores are currently drilled in formations having temperatures that are above 300° F. (149° C.). A majority of currently utilized mud pulsers include oil fillings, elastomers and/or electrical high pressure connectors, all of which tend to deteriorate over time and thus are not suitable for use in high temperature environments. The disclosure herein provides pulsers that are suitable for high temperature environments while also being made without oil fillings, elastomers or electrical high pressure connectors.

SUMMARY

Disclosed is a control valve assembly for use in a downhole tool in a wellbore including a body having a fluid passage including a fluid inlet and a fluid outlet. A portion of the body is formed from a first magnetic material. A sleeve slidingly mounted to the body. The sleeve selectively slides from a first position covering one of the fluid outlet and the fluid inlet to a second position exposing one of the fluid outlet and the fluid inlet. At least a portion of the sleeve is formed from a second magnetic material. A magnetic circuit having a gap is defined within the control valve assembly. The portion of the body formed from the first magnetic material defines a first portion of the magnetic circuit and the portion of the sleeve formed from the second magnetic material forms another portion of the magnetic circuit. A biasing member is in operable communication with the sleeve. A solenoid is mounted to the body about at least a portion of the first magnetic material of the body. The solenoid is selectively activated to create a magnetic field across the gap in the magnetic circuit. The magnetic circuit causes the sleeve to slide, narrowing the gap and sliding from the first position to the second position to produce a pressure pulse in the wellbore, wherein the biasing member biases the sleeve back to the first position.

Also disclosed a resource recovery and exploration system including an uphole system, and a downhole system including a downhole string extending into a wellbore operatively connected to the uphole system. The downhole string includes a pulser alternator generator having a main valve assembly, an alternator, and a control valve assembly operatively connected to the main valve assembly and the alternator. The control valve assembly includes a body having a fluid passage including a fluid inlet and a fluid outlet. A portion of the body is formed from a first magnetic material. A sleeve slidingly mounted to the body. The sleeve selectively slides from a first position covering one of the fluid outlet and the fluid inlet to a second position exposing one of the fluid outlet and the fluid inlet. At least a portion of the sleeve is formed from a second magnetic material. A magnetic circuit having a gap is defined within the control valve assembly. The portion of the body formed from the first magnetic material defines a first portion of the magnetic circuit and the portion of the sleeve formed from the second magnetic material forms another portion of the magnetic circuit. A biasing member is in operable communication with the sleeve. A solenoid is mounted to the body about at least a portion of the first magnetic material of the body. The solenoid is selectively activated to create a magnetic field across the gap in the magnetic circuit. The magnetic circuit causes the sleeve to slide, narrowing the gap and sliding from the first position to the second position to produce a pressure pulse in the wellbore, wherein the biasing member biases the sleeve back to the first position.

Further disclosed is a method of operating a control valve assembly in a wellbore including activating a solenoid to create a magnetic field in a magnetic circuit having a gap, passing the magnetic field across the gap in the magnetic circuit, and sliding a sleeve with the magnetic field thereby narrowing the gap, the sleeve sliding from a first position covering one of a fluid inlet and a fluid outlet to a second position uncovering one of the fluid inlet and the fluid outlet to produces a pressure pulse in the wellbore, wherein the sleeve in made from a magnetic material.

BRIEF DESCRIPTION OF THE DRAWINGS

Referring now to the drawings wherein like elements are numbered alike in the several Figures.

DETAILED DESCRIPTION

Figure 1:
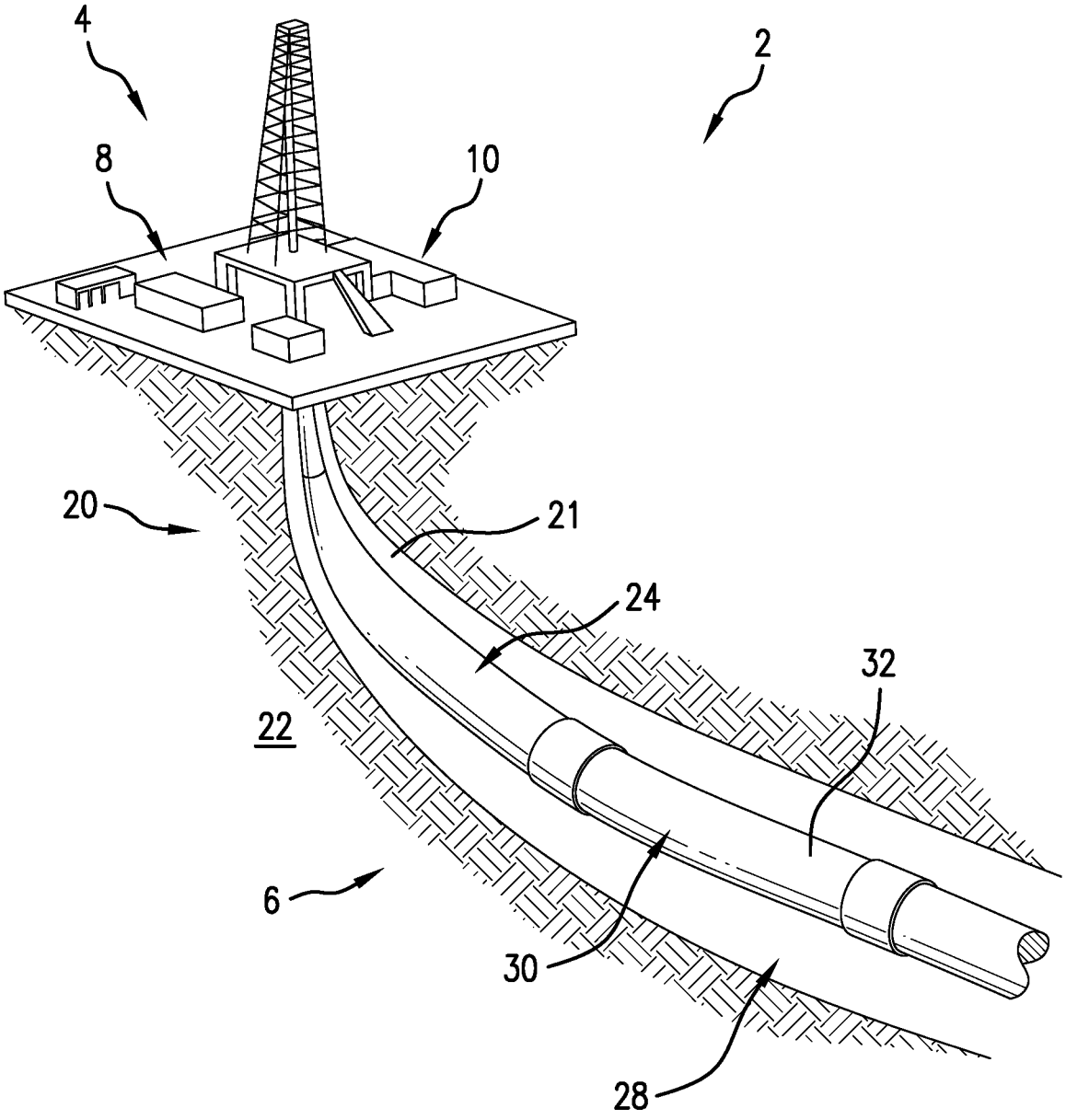
FIG. 1 depicts a resource exploration system having an uphole system operatively connected to a downhole string including a pulser alternator generator (PAG) having a sleeve control valve assembly, in accordance with an exemplary embodiment.

A drilling system (e.g. a resource exploration and/or recovery system), in accordance with an exemplary embodiment, is indicated generally at 2, in FIG. 1. Drilling system 2 should be understood to include well drilling operations, resource extraction and recovery, $CO_2$ sequestration, and the like. Drilling system 2 may include an uphole system 4 operatively connected to a downhole system 6. Uphole system 4 may include pumps 8 that aid in completion and/or extraction processes as well as fluid storage 10. Fluid storage 10 may contain a gravel pack fluid or slurry (not shown) that is introduced into downhole system 6.

Downhole system 6 may include a downhole string 20 that is extended into a wellbore 21 formed in formation 22. Downhole string 20 may include a number of connected downhole tools or tubulars 24. One of tubulars 24 may include a pulser alternator generator (PAG) assembly 28. PAG assembly 28 may receive signals from one or more sensors (not shown) indicating one or more of formation parameters, downhole fluid parameters, tool condition parameters and the like. PAG assembly 28 creates one or more pressure pulses that are received at uphole system 4. The one or more pressure pulses define a code that may contain information regarding data received by the sensors. In accordance with an exemplary embodiment, PAG assembly 28 creates pressure pulses by selectively stopping a flow of pressurized fluid such as downhole fluid or drilling mud as will be detailed more fully below.

Figure 2:
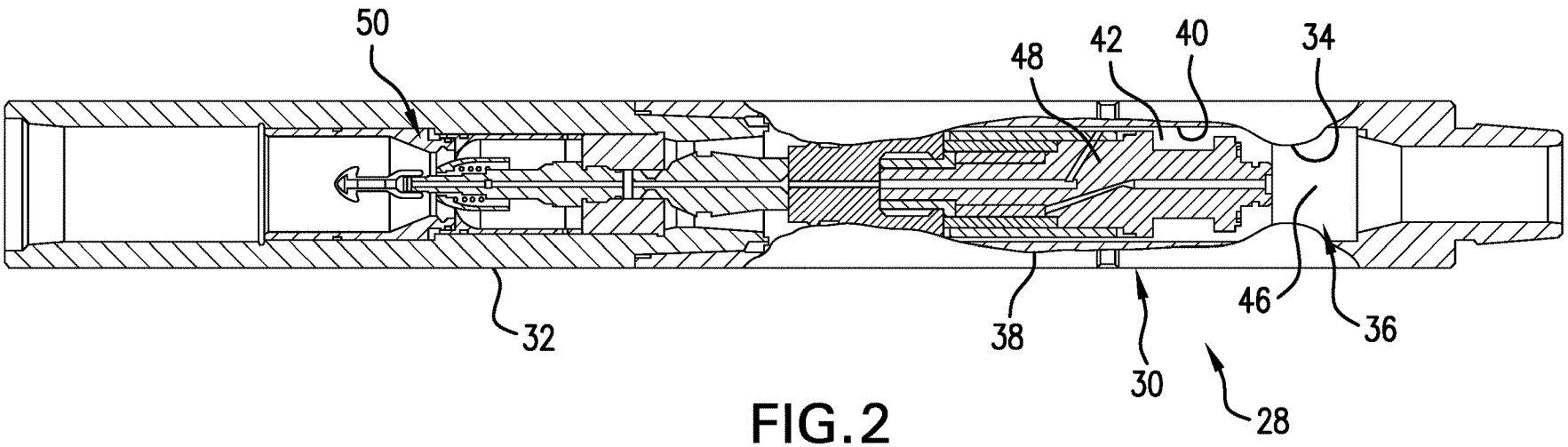
FIG. 2 depicts a partial cross-sectional view of the PAG of FIG. 1.

In accordance with an exemplary embodiment illustrated in FIG. 2, PAG assembly 28 includes a body portion 30 having an outer surface portion 32 and an inner portion 34. An inner housing 36 is arranged within inner portion 34. Inner housing 36 includes an outer surface 38 and an inner surface 40 that defines an interior portion 42. Interior portion 42 houses an alternator assembly 46, a control valve assembly (CVA) 48, and a main valve assembly (MVA) 50 having a mud flow inlet portion (not separately labeled) and a mud flow outlet portion (also not separately labeled). As will be detailed more fully below, alternator assembly 46 provides signals to CVA 48 that allow fluid or drilling mud to flow through MVA 50 and created pressure pulses in the drilling mud according to the signals. CVA 48 creates pressure pulses in the mud flow that provide downhole data from sensors or one or more processors in the downhole string (not shown) operatively coupled to alternator assembly 46 to uphole operators. In this disclosure the terms "mud flow" or "mud" is used synonymously with the term "fluid" or "flowing fluid.

Figure 3:
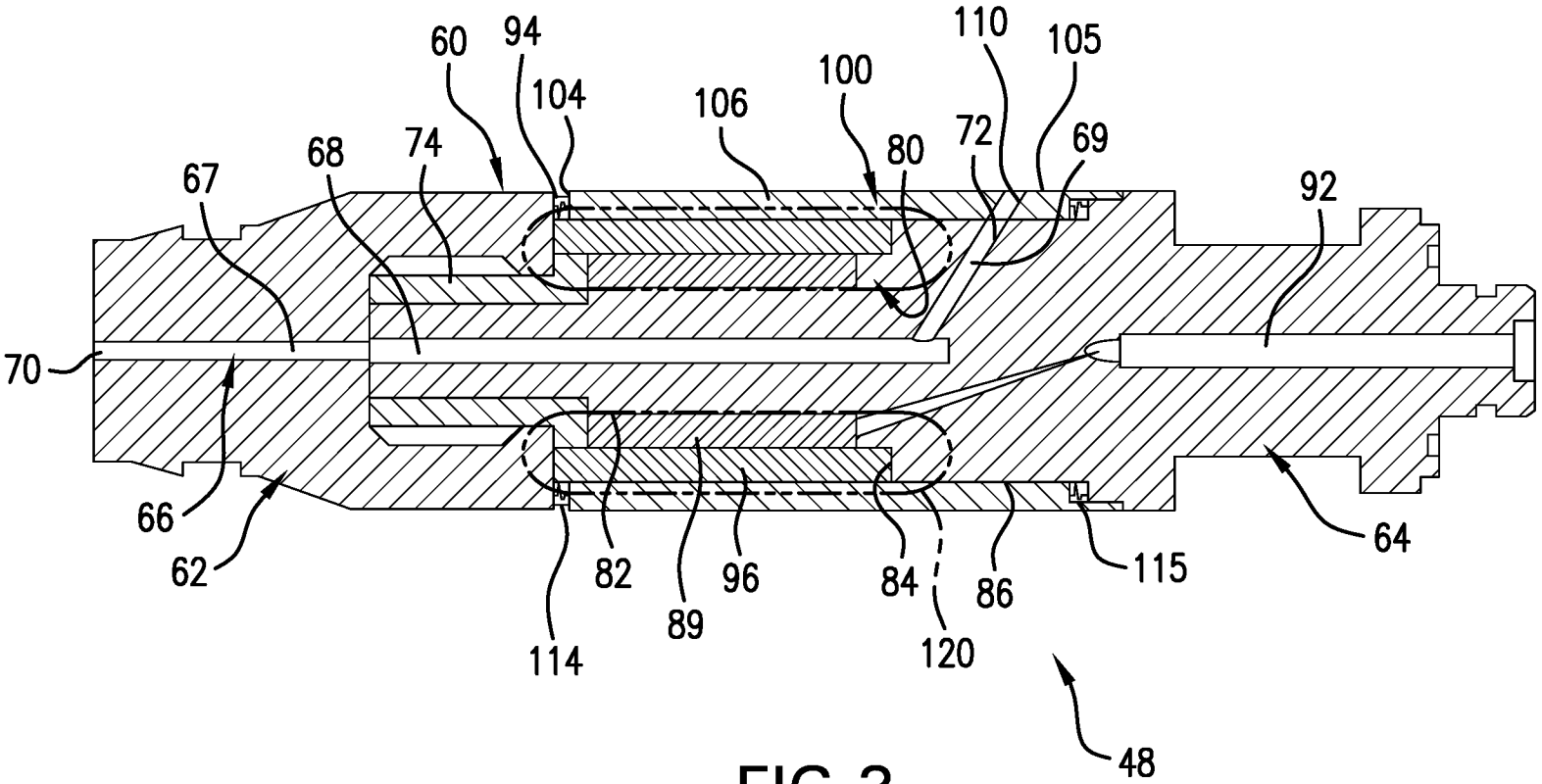
FIG. 3 depicts a sleeve control valve assembly, in accordance with an aspect of an exemplary embodiment.

As shown in FIG. 3, CVA 48 includes a body 60 including a first body portion 62 and a second body portion 64. A mud flow passage 66 extends through first body portion 62 and second body portion 64. In the exemplary embodiment shown, mud flow passage 66 includes a first passage portion 67 that extends through first body portion 62, a second passage portion 68, and a third passage portion 69. Both second passage portion 68 and third passage portion 69 extend through second body portion 64. Third passage portion 69 may extend at an angle relative to a longitudinal axis (not separately labeled) of CVA 48.

In accordance with an aspect of an exemplary embodiment, third passage portion 69 may extend at an angle of between about 20° and about 80° relative to a longitudinal axis (not separately labeled) of CVA 48. In accordance with another aspect, third passage portion 69 may extend at an angle of about 60° relative to the longitudinal axis. In this manner, impact forces associated with pulses of mud passing from third passage portion onto inner surface 40 may be reduced over those which would be realized if third passage portion 69 were perpendicular to the longitudinal axis. Mud flow passage 66 includes a mud flow inlet 70 arranged in first body portion 62 and a mud flow outlet 72 provided in second body portion 64. Mud flow inlet is fluidically connected with first passage portion 67 and mud flow outlet 72 is fluidically connected with third passage portion 69. First body portion 62 is joined to second body portion 64 through a pressure sleeve 74 that facilitates alignment of first passage portion 67 with second passage portion 68. Joining first and second body portion may be achieved for example through a press fit, a threaded connection or a joining process such a welding. In further accordance with an aspect of an exemplary embodiment, first and second body portions 62 and 64 as well as pressure sleeve 74 are formed from soft magnetic material. At this point, it should be understood that first and second body portions 62 and 64 and pressure sleeve 74 may be formed from substantially similar magnetic material or they may be formed from different magnetic materials depending upon desired performance characteristics.

In still further accordance with an exemplary embodiment, second body portion 64 includes an annular recessed portion 80 having a first section 82, a second section 84 and a third section 86. A solenoid 89 is positioned at first section 82 of recessed portion 80. Solenoid 89 is operatively coupled to alternator assembly 46 through a conductor (not shown) extending through a conductor passage 92. Alternator 46 provides signals to selectively activate, e.g., energize through an application of electric energy, solenoid 89, creating a magnetic flux or field in a magnetic circuit including a gap 94. A solenoid housing 96 which may take the form of a pressure sleeve is provided in second section 84 of annular recessed portion 80. Solenoid housing 96 extends about and protects solenoid 89 from downhole fluids passing through CVA 48 as well as from high downhole pressure. That is, housing 96 may be formed from a corrosion resistant high strength non-magnetic material such as Inconel to provide protection from corrosive high pressured downhole fluids.

In yet still further accordance with an exemplary aspect, CVA 48 includes a sleeve 100 slideably arranged in third section 86 of annular recessed portion 80. Sleeve 100 includes a first end portion 104, a second end portion 105 and a blocking portion 106 extending therebetween. Blocking portion 106 includes an opening 110 that selectively registers with fluid outlet 72. In embodiments opening 110 may register with a fluid inlet. In the embodiment shown, gap 94 exists between first end portion 104 and housing 60.

A biasing member, such as first spring 114 applies a biasing force onto sleeve 100 and is arranged between first end portion 104 and an annular surface of first body portion 62, also referred to as first wall portion of the first body portion (not separately labeled). A second spring 115 is arranged between second end portion 105 and another annular surface of third section 86, also referred to as second wall portion of the second body portion (also not separately labeled). It is to be mentioned that the term annular refers to the longitudinal axis of CVA 48. First and second springs 114 and 115 cooperate to maintain sleeve 100 in a first position wherein opening 110 exposes fluid (mud flow) outlet 72. Fluid outlet 72 is exposed when solenoid 100 is deactivated. When solenoid 100 is deactivated spring 114 will bias sleeve 100 in the first position. Spring 115 is dimensioned to be weaker (spring rate of spring 115 is smaller than spring rate of spring 114). In embodiments sleeve 100 may be functional with only the first spring 114. Spring 115 is good for supporting the sliding movement of sleeve 100 when solenoid 89 is activated. However, the magnetic forces initiated by activating solenoid 89 are sufficient to shift sleeve 100 without the additional force provided by spring 115.

In alternative embodiments hydraulic forces are used to drive the biasing member. The kinetic energy of the fluid flowing through the CVA 48 is used to push the sleeve back to the first position after the solenoid was deactivated. Sleeve 100 may include a structural feature which interferes with the flow path of the flowing fluid and creates a barrier onto which the flowing fluid applies a force which pushes the sleeve back towards the first position when the solenoid is deactivated. Applying a hydraulic force on the structural feature included in the sleeve works similar to a hydraulically driven piston.

With this arrangement, alternator assembly 46 provides signals to selectively activate solenoid 89 which, in turn, selectively shifts sleeve 100 between the first position (FIG. 3) and a second position. In the second position blocking portion 106 of sleeve 100 covers fluid (mud flow) outlet 72. In the first position fluid outlet register with opening 110 (FIG. 3), mud may flow through fluid outlet 72. When sleeve 100 is operated rapidly (activation, deactivation of solenoid 89) and is moved between the first position and the second position, pulses of mud pass from fluid outlet 72 and contact inner surface 40 of inner housing 36. Mud pulses travel through downhole string 20. An uphole receiver (not separately labeled) captures pressure waves created by the pulses of mud. The pressure pulses are presented in a pattern dictated by signals received from one or more sensors (formation parameters) or one or more processors in the downhole string 20. The pressure pulses may be decrypted to provide data regarding one or more downhole parameters to uphole operators. In embodiments opening 110 may register with the fluid outlet 72 when the solenoid 89 is activated and blocking portion 106 may cover fluid outlet 72 when solenoid 89 is deactivated (not shown). In alternative embodiments opening 110 may register with fluid outlet 72 when solenoid 89 is deactivated and blocking portion 106 may cover fluid outlet 72 when solenoid 89 is activated.

In accordance with an exemplary embodiment, a continuous flow of mud passes through CVA 48 and the mud pulse is created when the solenoid is activated to cover (close) the fluid outlet. Activating solenoid 89 closes a magnetic circuit in CVA 48 and narrows gap 94. Deactivating solenoid 89 allows the magnetic circuit to open (not separately labeled) by cutting off a magnetic flux or magnetic field 120 which was holding sleeve 100 in the second position. Gap 94 is opening. At this point, it should be understood that the term "magnetic circuit" defines a pathway of material within CVA 48 through which magnetic flux 120 will flow, because the magnetic reluctance of the material is low. The magnetic circuit, in the embodiment shown, may include first body portion 62, second body portion 64, pressure sleeve 74, and sleeve 100. Consequently, the magnetic flux 120 may flow through first body portion 62, second body portion 64, pressure sleeve 74, and sleeve 100. A magnetic field will arise across the gap 94 defined between sleeve 100 and first body portion 62 at first end 104. The magnetic field creates a magnetic force (attraction) that acts across the gap 94 causing sleeve 100 to slide towards first body portion 62. Sleeve 100 slides along a longitudinal axis of the body narrowing the gap 94. Gap 94 need not fully close in order to cover fluid outlet 72 and to close the control valve. The gap 94 need only close so far as to at least partially cover fluid outlet 72 to block at least partially the flowing fluid to reduce the flow rate of the mud flow through fluid outlet 72 and to generate the pressure pulse. Solenoid 89 may then be deactivated widening gap 94 and opening (interrupting) the magnetic circuit cutting off magnetic flux 120 allowing spring 114 to bias sleeve 100 back to the first position, opening the control valve. In the first position the width of gap 94 is larger than the width of gap 94 in the second position. The first position is also referred to as a gap open position, the second position is also referred to as a gap closed position. The gap closed position does not require that the gap to be fully closed.

In accordance with an aspect of an exemplary embodiment, sleeve 100, first body portion 62, second body portion 64, and pressure sleeve 74 may be formed from a magnetic material, such as a soft magnetic material, e.g., Vacoflux® 9CR from Vacuumschmelze GmbH and Co. Magnetic and soft-magnetic materials are defined as having a magnetic permeability $\mu$ that is greater than about $1.26*10^{-4}$ $N/A^2$ (ferromagnetic or ferrimagnetic material). The magnetic or soft-magnetic material may also be corrosion resistant. At this point, it should be understood that the term magnetic material includes any suitable material that may form part of a magnetic circuit including soft magnetic material. In alternative embodiments only portions of sleeve 100, first body portion 62, second body portion 64, and pressure sleeve 74 may be formed from a magnetic material, such as a soft magnetic material. Sleeve 100, first body portion 62, second body portion 64, and pressure sleeve 74 may be made from a magnetic material that is also corrosion resistant. Sleeve 100, first body portion 62, second body portion 64, and pressure sleeve 74 may be made from substantially similar magnetic materials or different magnetic materials depending upon desired performance characteristics.

In accordance with another aspect of an exemplary embodiment, sleeve 100 is formed from diamond coated soft magnetic material. In this manner, sleeve 100 may withstand corrosive and abrasive properties of downhole fluids such as downhole mud or fluid passing through CVA 48 at high downhole temperatures. Solenoid housing 96 is formed from high-strength, non-magnetic material such as Inconel. The particular materials are chosen to provide corrosion resistance to downhole fluids. Other materials that may also resist corrosion may also be employed.

Figure 4:
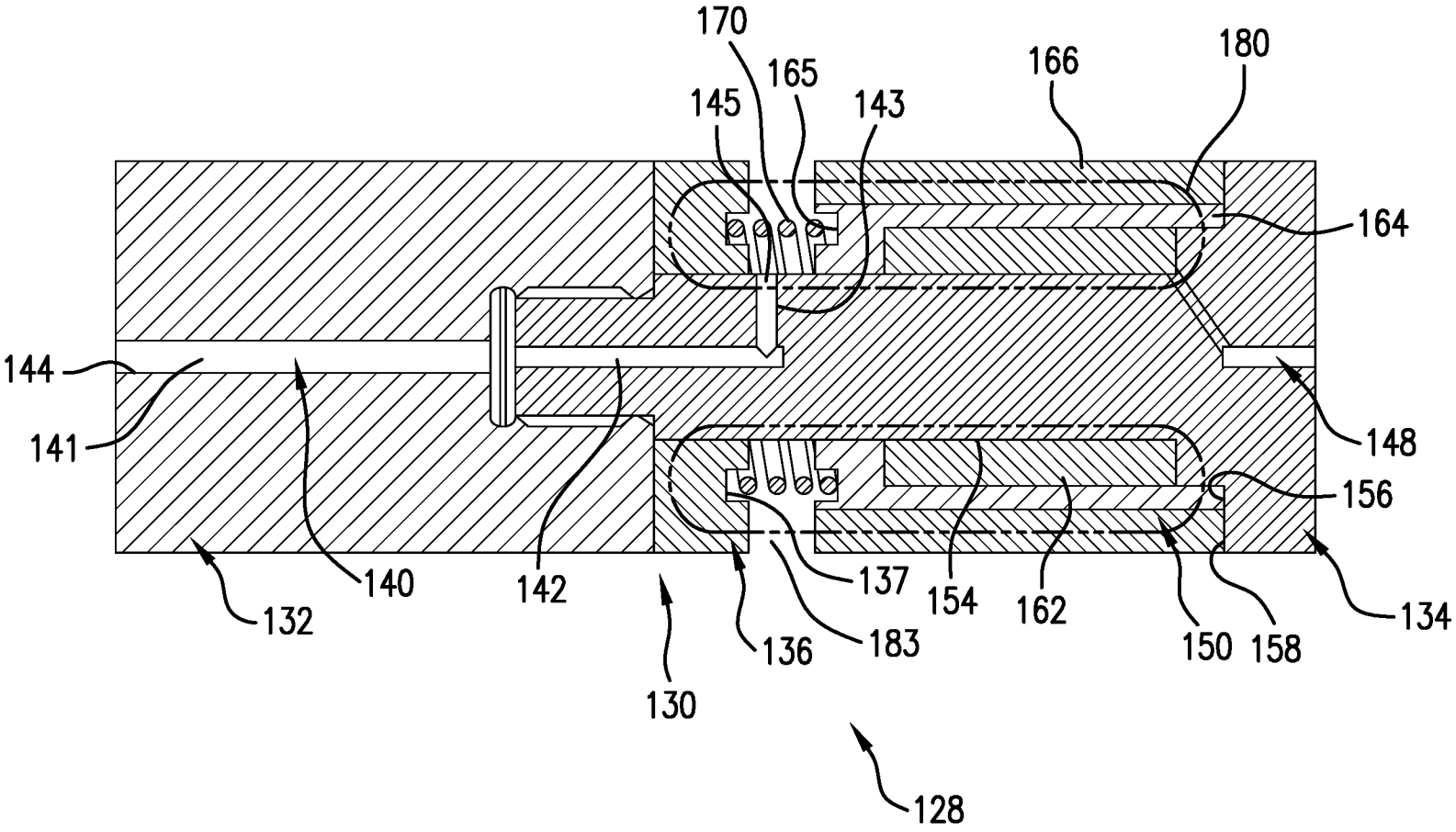
FIG. 4 depicts a sleeve control valve assembly, in accordance with another aspect of an exemplary embodiment.

In the embodiment of control valve 48, the solenoid 89 may be placed in a sealed and clean 1-bar environment. In the embodiment of the device 48 in FIG. 3, sleeve 100 moves when the solenoid in the control valve 48 is energized. Sleeve 100 slides in an environment that is flooded with fluid (mud). The presence of mud allows sleeve 100 to slide back and forth (from first position to second position and vice versa) with relative low friction. Reference will now follow to FIG. 4 in describing a CVA 128 in accordance with another aspect of an exemplary embodiment. CVA 128 includes a body 130 having a first body portion 132 that is mechanically linked to a second body portion 134. First body portion 132 and second body portion 134 may be formed from soft magnetic material. A plate member 136 is arranged between first and second body portions 132 and 134. Plate member 136 may be formed from soft magnetic material and may include a first annular recess 137. A mud flow passage 140 extends through body 140. Mudflow passage 130 includes a first passage portion 141 extending through first body portion 132 and a second passage portion 142 extending through second body portion 134. A third passage portion 143 extends substantially perpendicularly from second passage portion 142. In embodiments third passage 143 may extend at an angle substantially different to 90. Mudflow passage 140 includes a mud flow inlet 144 fluidically connected to first passage portion 141 and a mud flow outlet 145 fluidically connected to third passage portion 143. Second body portion 134 also includes a conductor passage 148 extending therethrough.

In accordance with an aspect of an exemplary embodiment, second body portion 134 also includes an annular recessed portion 150 having a first section 154, a second section 156 and a third section 158. A solenoid 162 is arranged in first section 154 of annular recessed portion 150. Solenoid 162 is electrically connected to alternator assembly 46 via a conductor (not shown) extending through conductor passage 148. A pressure sleeve 164 is arranged in second section 156 of annular recessed portion 150. A housing which may take form of a pressure sleeve or solenoid housing 164 extends about and provides protection for solenoid 162. Solenoid housing 164 is, in accordance with an aspect of an exemplary embodiment, is formed from magnetic material and may include an annular recess 165.

In further accordance with an aspect of an exemplary embodiment, CVA 128 includes a sleeve 166 arranged in third section 158 of annular recessed portion 150. Sleeve 166 is mechanically linked with solenoid housing 164 and may be formed from a soft magnetic material as will be detailed herein. Sleeve 166, together with solenoid housing 164 are selectively shiftable between a first position (FIG. 4) wherein mud flow outlet 145 is exposed and a second position (not shown) wherein mud flow outlet 145 is at least partially closed. Closed in this context refers to covered by sleeve 166. A return spring 170 biases sleeve 166 and solenoid housing 164 in the first position. Return spring 170 nests within first and second annular recesses 137 and 165. Solenoid housing may be formed from a corrosion resistant magnetic material to provide protection from corrosive high pressured downhole fluids.

In accordance with an aspect of an exemplary embodiment, sleeve 166, first body portion 132, second body portion 134, solenoid housing 164, and plate member 136 may be formed from a magnetic material, such as a soft magnetic material, e.g., Vacoflux® 9CR from Vacuumschmelze GmbH and Co. Magnetic and soft-magnetic materials are defined as having a magnetic permeability $\mu$ that is greater than about $1.26*10^{-4}$ $N/A^2$ (ferromagnetic or ferrimagnetic material). The magnetic or soft-magnetic material may also be corrosion resistant. At this point, it should be understood that the term magnetic material includes any suitable material that may form part of a magnetic circuit including soft magnetic material. In alternative embodiments only portions of sleeve 166, first body portion 132, second body portion 134, solenoid housing 164, and plate member 136 may be formed from a magnetic material. Further, it should be understood that sleeve 166, first body portion 132, second body portion 134, solenoid housing 164, and plate member 136 may be formed from substantially similar magnetic materials or they may be formed from different magnetic materials depending upon desired performance characteristics.

With this arrangement, alternator assembly 46 provides signals to selectively activate solenoid 162 which, in turn, shifts sleeve 166 from the first position to the second position. In the first position, mud may flow through fluid (mud flow) outlet 145. Activating solenoid 162 closes a magnetic circuit in CVA 48 and covers mud flow outlet 145. Deactivating solenoid 162 allows the magnetic circuit to open by cutting off the magnetic flux or magnetic field 180, which were holding sleeve 166 in the second position. When solenoid 162 is energized, magnetic field 180 crosses a gap 183 defined between sleeve 166 and plate member 136. At this point, it should be understood that the term "magnetic circuit" defines a pathway of material within CVA 48 through which magnetic flux 180 will flow. The magnetic circuit, in the embodiment shown, may include first body portion 132, second body portion 134, plate member 136, pressure sleeve 164, and sleeve 166.

When sleeve 166 is operated rapidly (activation, deactivation of solenoid 162) and is moved between the first position and the second position, pulses of mud pass from mud flow outlet 145 and contact inner surface 40 of inner housing 36. An uphole receiver (not separately labeled) captures pressure waves created by the pulses of mud. The pressure pulses are presented in a pattern dictated by signals received from one or more sensors or one or more processors in the downhole string 20. The pressure pulses may be decrypted to provide data regarding one or more downhole parameters to uphole operators. Gap 183 need not fully close in order to cover mud flow outlet 145 and to close the control valve. The gap 183 need only close so far as to at least partially cover mud flow outlet 145 to block at least partially the flowing fluid (mud) to reduce the flow rate of the mud flow through mud flow outlet 145 and to generate the pressure pulse.

Set forth below are some embodiments of the foregoing disclosure:

Embodiment 1. A control valve assembly for use in a downhole tool in a wellbore comprising: a body including a fluid passage having a fluid inlet and a fluid outlet, wherein at least a portion of the body is formed from a first magnetic material; a sleeve slidingly mounted to the body, the sleeve selectively sliding from a first position covering one of the fluid outlet and the fluid inlet to a second position exposing one of the fluid outlet and the fluid inlet, wherein at least a portion of the sleeve is formed from a second magnetic material; a magnetic circuit having a gap defined within the control valve assembly, wherein the portion of the body formed from the first magnetic material defines a first portion of the magnetic circuit and the portion of the sleeve formed from the second magnetic material forms another portion of the magnetic circuit; a biasing member in operable communication with the sleeve; and a solenoid mounted to the body about at least a portion of the first magnetic material of the body, the solenoid being selectively activated to create a magnetic field across the gap in the magnetic circuit, the magnetic circuit causing the sleeve to slide, narrowing the gap and sliding from the first position to the second position to produce a pressure pulse in the wellbore, wherein the biasing member biases the sleeve back to the first position.

Embodiment 2. The control valve assembly according to any prior embodiment, wherein the sleeve includes an opening that selectively registers with one of the fluid outlet and the fluid inlet in the first position.

Embodiment 3. The control valve assembly according to any prior embodiment, wherein the body includes a sleeve receiving recess including at least one wall portion, the sleeve including a first end portion, a second end portion and a blocking portion nesting within the sleeve receiving recess.

Embodiment 4. The control valve assembly according to any prior embodiment, further comprising: a spring arranged between the at least one wall portion and one of the first and second end portions of the sleeve.

Embodiment 5. The control valve assembly according to any prior embodiment, wherein the body includes a first body portion operatively coupled to a second body portion, the sleeve receiving recess being formed between the first and second body portions.

Embodiment 6. The control valve assembly according to any prior embodiment, wherein the at least one wall portion includes a first wall portion defined by the first body portion and a second wall portion defined by the second body portion, the biasing member comprising a spring arranged between the first wall portion and the first end portion of the sleeve.

Embodiment 7. The control valve assembly according to any prior embodiment, wherein the first magnetic material is substantially similar to the second magnetic material.

Embodiment 8. The control valve assembly according to any prior embodiment, wherein at least a portion of the sleeve is formed from a soft magnetic material.

Embodiment 9. The control valve assembly according to any prior embodiment, wherein at least a portion of the sleeve is formed from a diamond coated soft magnetic material.

Embodiment 10. A resource recovery and exploration system comprising: an uphole system; and a downhole system including a downhole string extending into a wellbore operatively connected to the uphole system, the downhole string including a pulser alternator generator having a main valve assembly, an alternator, and a control valve assembly operatively connected to the main valve assembly and the alternator, the control valve assembly comprising: a body including a fluid passage having a fluid inlet and a fluid outlet, wherein at least a portion of the body is formed from a first magnetic material; a sleeve slidingly mounted to the body, the sleeve selectively sliding from a first position covering one of the fluid outlet and the fluid inlet to a second position exposing one of the fluid outlet and the fluid inlet, wherein at least a portion of the sleeve is formed from a second magnetic material; a magnetic circuit having a gap defined within the control valve assembly, wherein the portion of the body formed from the first magnetic material defines a first portion of the magnetic circuit and the portion of the sleeve formed from the second magnetic material forms another portion of the magnetic circuit; a biasing member in operable communication with the sleeve; and a solenoid mounted to the body about at least a portion of the first magnetic material of the body, the solenoid being selectively activated to create a magnetic field across the gap in the magnetic circuit, the magnetic circuit causing the sleeve to slide, narrowing the gap and sliding from the first position to the second position to produce a pressure pulse in the wellbore, wherein the biasing member biases the sleeve back to the first position.

Embodiment 11. The resource recovery and exploration system according to any prior embodiment, wherein the sleeve includes an opening that selectively registers with one of the fluid outlet and the fluid inlet in the first position.

Embodiment 12. The resource recovery and exploration system according to any prior embodiment, wherein the body includes a sleeve receiving recess including at least one wall portion, the sleeve including a first end portion, a second end portion and a blocking portion nesting within the sleeve receiving recess.

Embodiment 13. The resource recovery and exploration system according to any prior embodiment, further comprising: a spring arranged between the at least one wall portion and one of the first and second end portions of the sleeve.

Embodiment 14. The resource recovery and exploration system according to any prior embodiment, wherein the body includes a first body portion operatively coupled to a second body portion, the sleeve receiving recess being formed between the first and second body portions.

Embodiment 15. The resource recovery and exploration system according to any prior embodiment, wherein the at least one wall portion includes a first wall portion defined by the first body portion and a second wall portion defined by the second body portion, the biasing member comprising a spring arranged between the first wall portion and the first end portion of the sleeve.

Embodiment 16. The resource recovery and exploration system according to any prior embodiment, wherein the first magnetic material is substantially similar to the second magnetic material.

Embodiment 17. The resource recovery and exploration system according to any prior embodiment, wherein at least a portion of the sleeve is formed from a soft magnetic material.

Embodiment 18. The resource recovery and exploration system according to any prior embodiment, wherein at least a portion of the sleeve is formed from a diamond coated soft magnetic material.

Embodiment 19. A method of operating a control valve assembly in a wellbore comprising: activating a solenoid to create a magnetic field in a magnetic circuit having a gap; passing the magnetic field across the gap in the magnetic circuit; and sliding a sleeve with the magnetic field thereby narrowing the gap, the sleeve sliding from a first position covering one of a fluid inlet and a fluid outlet to a second position uncovering one of the fluid inlet and the fluid outlet to produce a pressure pulse in the wellbore, wherein at least a portion of the sleeve is made from a magnetic material.

Embodiment 20. The method according to any prior embodiment, further comprising: biasing the sleeve back to the first position.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc.

The term "about" is intended to include the degree of error associated with measurement of the particular quantity based upon the equipment available at the time of filing the application. For example, "about" can include a range of ±8% or 5%, or 2% of a given value.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A control valve assembly for use in a downhole tool in a wellbore comprising:

a body including a fluid passage having a fluid inlet and a fluid outlet, wherein at least a portion of the body is formed from a first magnetic material;

a sleeve slidingly mounted to the body, the sleeve selectively sliding from a first position covering one of the fluid outlet and the fluid inlet to a second position exposing one of the fluid outlet and the fluid inlet, wherein at least a portion of the sleeve is formed from a second magnetic material;

a magnetic circuit having a gap defined within the control valve assembly, wherein the portion of the body formed from the first magnetic material defines a first portion of the magnetic circuit and the portion of the sleeve formed from the second magnetic material forms another portion of the magnetic circuit;

a biasing member in operable communication with the sleeve; and a solenoid mounted to the body about at least a portion of the first magnetic material of the body, the solenoid being selectively activated to create a magnetic field across the gap in the magnetic circuit, the magnetic circuit causing the sleeve to slide, narrowing the gap and sliding from the first position to the second position to produce a pressure pulse in the wellbore, wherein the biasing member biases the sleeve back to the first position.

2. The control valve assembly according to claim 1, wherein the sleeve includes an opening that selectively registers with one of the fluid outlet and the fluid inlet in the first position.

3. The control valve assembly according to claim 1, wherein the body includes a sleeve receiving recess including at least one wall portion, the sleeve including a first end portion, a second end portion and a blocking portion nesting within the sleeve receiving recess.

4. The control valve assembly according to claim 3, further comprising: a spring arranged between the at least one wall portion and one of the first and second end portions of the sleeve.

5. The control valve assembly according to claim 3, wherein the body includes a first body portion operatively coupled to a second body portion, the sleeve receiving recess being formed between the first and second body portions.

6. The control valve assembly according to claim 5, wherein the at least one wall portion includes a first wall portion defined by the first body portion and a second wall portion defined by the second body portion, the biasing member comprising a spring arranged between the first wall portion and the first end portion of the sleeve.

7. The control valve assembly according to claim 1, wherein the first magnetic material is substantially similar to the second magnetic material.

8. The control valve assembly according to claim 1, wherein at least a portion of the sleeve is formed from a soft magnetic material.

9. The control valve assembly according to claim 1, wherein at least a portion of the sleeve is formed from a diamond coated soft magnetic material.

10. A resource recovery and exploration system comprising:

an uphole system; and a downhole system including a downhole string extending into a wellbore operatively connected to the uphole system, the downhole string including a pulser alternator generator having a main valve assembly, an alternator, and a control valve assembly operatively connected to the main valve assembly and the alternator, the control valve assembly comprising:

a body including a fluid passage having a fluid inlet and a fluid outlet, wherein at least a portion of the body is formed from a first magnetic material;

a sleeve slidingly mounted to the body, the sleeve selectively sliding from a first position covering one of the fluid outlet and the fluid inlet to a second position exposing one of the fluid outlet and the fluid inlet, wherein at least a portion of the sleeve is formed from a second magnetic material;

a magnetic circuit having a gap defined within the control valve assembly, wherein the portion of the body formed from the first magnetic material defines a first portion of the magnetic circuit and the portion of the sleeve formed from the second magnetic material forms another portion of the magnetic circuit;

a biasing member in operable communication with the sleeve; and a solenoid mounted to the body about at least a portion of the first magnetic material of the body, the solenoid being selectively activated to create a magnetic field across the gap in the magnetic circuit, the magnetic circuit causing the sleeve to slide, narrowing the gap and sliding from the first position to the second position to produce a pressure pulse in the wellbore, wherein the biasing member biases the sleeve back to the first position.

11. The resource recovery and exploration system according to claim 10, wherein the sleeve includes an opening that selectively registers with one of the fluid outlet and the fluid inlet in the first position.

12. The resource recovery and exploration system according to claim 10, wherein the body includes a sleeve receiving recess including at least one wall portion, the sleeve including a first end portion, a second end portion and a blocking portion nesting within the sleeve receiving recess.

13. The resource recovery and exploration system according to claim 12, further comprising: a spring arranged between the at least one wall portion and one of the first and second end portions of the sleeve.

14. The resource recovery and exploration system according to claim 12, wherein the body includes a first body portion operatively coupled to a second body portion, the sleeve receiving recess being formed between the first and second body portions.

15. The resource recovery and exploration system according to claim 14, wherein the at least one wall portion includes a first wall portion defined by the first body portion and a second wall portion defined by the second body portion, the biasing member comprising a spring arranged between the first wall portion and the first end portion of the sleeve.

16. The resource recovery and exploration system according to claim 10, wherein the first magnetic material is substantially similar to the second magnetic material.

17. The resource recovery and exploration system according to claim 10, wherein at least a portion of the sleeve is formed from a soft magnetic material.

18. The resource recovery and exploration system according to claim 10, wherein at least a portion of the sleeve is formed from a diamond coated soft magnetic material.

19. A method of operating a control valve assembly in a wellbore comprising:

activating a solenoid to create a magnetic field in a magnetic circuit having a gap;

passing the magnetic field across the gap in the magnetic circuit; and sliding a sleeve mounted to a body with the magnetic field thereby narrowing the gap, the sleeve sliding from a first position covering one of a fluid inlet and a fluid outlet to a second position uncovering one of the fluid inlet and the fluid outlet to produce a pressure pulse in the wellbore, wherein the body is formed from a first magnetic material, and wherein at least a portion of the sleeve is made from a second magnetic material.

20. The method of claim 19, further comprising: biasing the sleeve back to the first position with a biasing member in operable communication with the sleeve.

* * * * *